US011557831B2

(12) United States Patent
Wong

(10) Patent No.: US 11,557,831 B2
(45) Date of Patent: Jan. 17, 2023

(54) AUDIO DEVICE

(71) Applicant: Team IP Holdings, LLC, Grand Prairie, TX (US)

(72) Inventor: Tenvoon Wong, Oakville (CA)

(73) Assignee: Team IP Holdings, LLC, Grand Prairie, TX (US)

( * ) Notice: Subject to any disclaimer, the term of this patent is extended or adjusted under 35 U.S.C. 154(b) by 36 days.

(21) Appl. No.: 17/249,553

(22) Filed: Mar. 4, 2021

(65) Prior Publication Data

US 2021/0194117 A1 Jun. 24, 2021

Related U.S. Application Data

(62) Division of application No. 15/991,158, filed on May 29, 2018, now Pat. No. 10,957,972.

(51) Int. Cl.

| | |
|---|---|
| ***H01Q 1/38*** | (2006.01) |
| ***H01Q 9/28*** | (2006.01) |
| ***H01Q 9/26*** | (2006.01) |

(52) U.S. Cl.

CPC ..... *H01Q 1/38* (2013.01); *H01Q 9/26* (2013.01); *H01Q 9/285* (2013.01)

(58) Field of Classification Search

CPC ..... H01Q 1/38; H01Q 9/26; H01Q 9/285; H01Q 1/273; G06K 19/077; H04R 2225/55; H04R 2225/021; H04R 2225/025

See application file for complete search history.

(56) References Cited

U.S. PATENT DOCUMENTS

| | | | | |
|---|---|---|---|---|
| 6,674,869 | B2 * | 1/2004 | Paczkowski | H04R 25/609 381/328 |
| 9,620,861 | B1 | 4/2017 | Banks | |
| 2002/0175874 | A1 | 11/2002 | Eason | |
| 2003/0054855 | A1 | 3/2003 | Kojola et al. | |
| 2004/0001021 | A1 * | 1/2004 | Choo | H01Q 5/364 343/700 MS |
| 2005/0110682 | A1 | 5/2005 | Tran | |
| 2006/0170604 | A1 | 8/2006 | Almog et al. | |
| 2008/0001838 | A1 | 1/2008 | Huang et al. | |
| 2008/0094297 | A1 | 4/2008 | Petkov et al. | |

(Continued)

FOREIGN PATENT DOCUMENTS

| | | | |
|---|---|---|---|
| CN | 104640044 | A | 5/2015 |
| EP | 2 824 942 | A1 | 1/2015 |
| KR | 10-2015-0107477 | A | 9/2015 |

OTHER PUBLICATIONS

International Search Report and Written Opinion dated Sep. 20, 2019, received in International Patent Application No. PCT/US2019/03406.

*Primary Examiner* — David E Lotter

(74) *Attorney, Agent, or Firm* — Knobbe, Martens, Olson & Bear LLP

(57) ABSTRACT

An audio device (e.g., hearing aid) can optionally have a radio-frequency antenna that includes an antenna structure on a flexible printed circuit board. The antenna structure can have one or metal traces disposed on the flexible printed circuit board, the antenna structure extending over an area that substantially coincides with the area of the flexible printed circuit board. The flexible printed circuit board is foldable into a three-dimensional structure that can be disposed in a folded configuration in an audio device (e.g., hearing aid).

4 Claims, 7 Drawing Sheets

(56) References Cited

U.S. PATENT DOCUMENTS

| | | | | |
|---|---|---|---|---|
| 2009/0318094 | A1* | 12/2009 | Pros | H01Q 21/29 455/75 |
| 2011/0095955 | A1 | 4/2011 | Cohen | |
| 2012/0065946 | A1* | 3/2012 | Brown | H01Q 1/00 703/1 |
| 2013/0229311 | A1 | 9/2013 | Chi et al. | |
| 2014/0028505 | A1 | 1/2014 | Baliarda et al. | |
| 2015/0281859 | A1 | 10/2015 | Fischer et al. | |
| 2016/0190699 | A1 | 6/2016 | Yang | |
| 2016/0285168 | A1 | 9/2016 | Puente Baliarda | |
| 2017/0070829 | A1 | 3/2017 | Polinske | |
| 2017/0156011 | A1 | 6/2017 | Rasmussen | |

* cited by examiner

AUDIO DEVICE

CROSS-REFERENCE TO RELATED APPLICATIONS

Any and all applications for which a foreign or domestic priority claim is identified in the Application Data Sheet as filed with the present application are hereby incorporated by reference under 37 CFR 1.57, and should be considered a part of this specification.

BACKGROUND

Field

Aspects of the disclosure relate to an audio device and a radio-frequency antenna for the same, and more particularly to a wireless audio device with a 2D planar antenna that can assume a 3D shape and conform to the form factor of the device worn on the human body.

Description of the Related Art

One conventional and widely use antenna type is a dipole antenna, the most common being the half-wave dipole, which has two conductive elements that are a quarter wavelength long. The radiation pattern of a vertical dipole is omnidirectional with a maximum antenna gain of 2.15 dBi. The impedance at the feed point of the antenna is determined by several factors, including the physical length of the conductive elements of the antenna.

Conventional antennas involve incorporating the antenna on a printed circuit board (PCB), such as on a PCB module layer. For example, the antenna is applied on a top layer of the PCB module. In applications where the size of the antenna needs to be small, a fractal structure is one technique that has been used to reduce the size of the conductive elements of the antenna. However, existing antenna designs have several drawbacks that makes them unsuitable for use in bodily worn devices, such as hearing aids, earphones or headphones. For example, existing antenna designs are unsuitable for product form factors having irregular shapes, or that have irregularly shaped PCBs.

Various fractal structures commonly used in spatially constrained designs are unsuitable as they require a regular shape (e.g., regular shaped PCB). Forcing a fractal antenna structure into an irregular shape would result in further reduction in size of the fractal antenna, resulting in unused and/or wasted area on the PCB. Additionally, fractal antenna structure would be negatively impacted by an asymmetrical loading effect where the antenna is in close proximity to the human body, which can shift the ideal matching condition at the terminals of the antenna outside the desired frequency band, leaving the antenna circuit an ineffective radiator.

SUMMARY

Accordingly, there is a need for an improved audio device, such as one with an antenna that addresses some of the disadvantages in conventional antenna designs used on printed circuit boards (PCB) or on module PCB layers, such as those discussed above.

In accordance with one aspect, an audio device is provided. The audio device comprises an outer casing configured to be worn proximate a human ear, and an antenna housed in the outer casing. The antenna comprises a flexible printed circuit board including one or more layers extending along an area in a two-dimensional plane. The antenna also comprises an antenna structure comprising one or metal traces disposed on at least one of the layers of the printed circuit board. The one or more traces are arranged in a plurality of rows connected in series with each other and arranged generally parallel to each other, each row comprising a plurality of repeating non-linear elements of identical size and shape. The antenna structure extends over the area of the flexible printed circuit board so that at least a portion of the one or more metal traces is adjacent a perimeter boundary of the flexible printed circuit board, irrespective of the shape of the area of the flexible printed circuit board. The flexible printed board is foldable into a three-dimensional structure configured to conform with a shape of the outer casing, the repeating cell elements configured to minimize a loading effect on the antenna structure when the outer casing is placed in proximity to a human head.

In accordance with another aspect, a radio-frequency antenna for an audio device is provided. The antenna comprises a flexible printed circuit board including one or more layers extending along an area in a two-dimensional plane, and an antenna structure comprising one or metal traces disposed on at least one of the layers of the printed circuit board. The antenna structure extends over an area that substantially coincides with the area of the flexible printed circuit board. The flexible printed board is foldable into a three-dimensional structure configured to be disposed in a folded configuration in an audio device.

In accordance with another aspect, a radio-frequency antenna for an audio device is provided. The antenna comprises a flexible printed circuit board including one or more layers extending along an area in a two-dimensional plane, and an antenna structure comprising one or metal traces disposed on at least one of the layers of the printed circuit board. The one or more traces are arranged in a non-fractal pattern comprising a plurality of rows connected in series and arranged generally parallel to each other, each of the plurality of rows comprising a plurality of repeating non-linear cell elements. The antenna structure extends across the area of the flexible printed circuit board so that at least a portion of the one or more metal traces is adjacent a boundary of the flexible printed circuit board along a perimeter of the flexible printed circuit board, irrespective of the shape of the area of the flexible printed circuit board. The flexible printed board is foldable into a three-dimensional structure configured to be disposed in a folded configuration in an audio device.

In accordance with another aspect, a method for determining design parameters of an antenna for an audio device, where the antenna includes one or more metal traces disposed on a printed circuit board is provided. The method comprises calculating a total available area on a printed circuit board, calculating a length of a unit cell element based at least in part on the calculated total available surface area of an implementation space on the printed circuit board, determining a coverage area of the unit cell element, calculating the number of unit cell elements needed for the antenna by dividing the total available surface area by the coverage area of the unit cell element, and determining via computer implemented software a length of the one or more metal traces by multiplying the number of unit cell elements by the length of the unit cell element.

DETAILED DESCRIPTION

Figure 1:
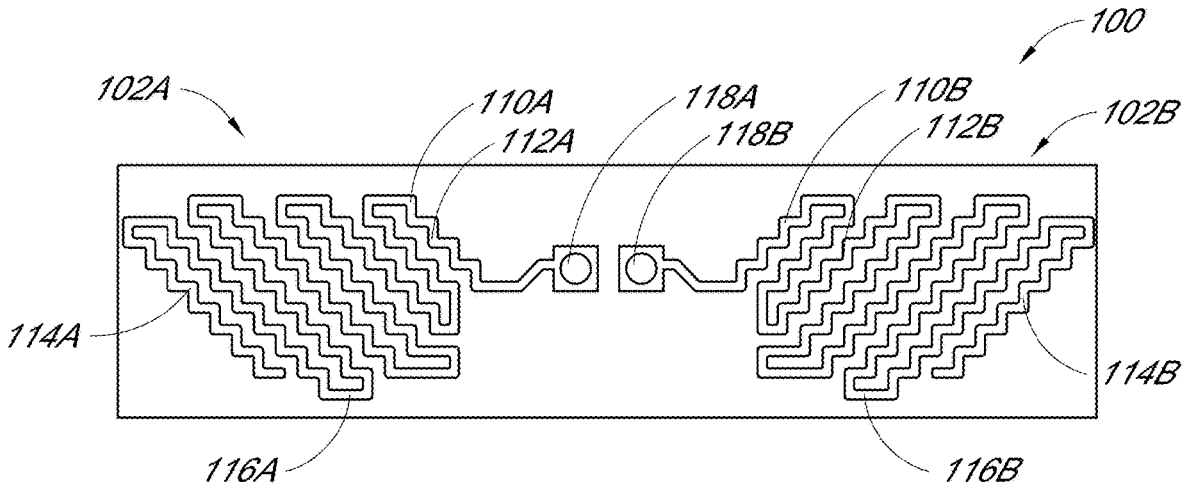
FIG. 1 is a schematic view of a two-dimensional (2D) planar design for an antenna.

The headings provided herein, if any, are for convenience only and do not necessarily affect the scope or meaning of the claimed invention.

The following detailed description of certain embodiments present various descriptions of specific embodiments. However, the innovations described herein can be embodied in a multitude of different ways, for example, as defined and covered by the claims. In this description, reference is made to the drawings where like reference numerals can indicate identical or functionally similar elements. It will be understood that elements illustrated in the figures are not necessarily drawn to scale. Moreover, it will be understood that certain embodiments can include more elements than illustrated in a figure and/or a subset of the elements illustrated in a figure. Further, some embodiments can incorporate any suitable combination of features from two or more figures.

Disclosed herein are embodiments of integrated antenna modules including an antenna on a printed circuit board. Advantageously, the antenna can be sized and shape to fit on the printed circuit board, as further discussed below.

FIG. 1 shows one embodiment of an antenna 100. In the illustrated embodiment, the antenna is a symmetrical dipole antenna 100 that extends along a two-dimensional (2D) plane. The antenna 100 can include a pair of arms 102A, 102B defined at least in part by one or more metal traces 110A, 110B. In the illustrated embodiment, the radiating arms 102A, 102B have a shape that are mirror images of each other. The metal traces 110A, 110B can include a plurality of cell elements 112A, 112B connected in series that define a repeating structure. The plurality of cell elements 112A, 112B can have the same size, shape and orientation. Optionally, the metal traces 110A, 110B can be arranged in two or more rows, for example a plurality of rows 114A, 114B, each including (e.g., defined at least in part by) a plurality of the cell elements 112A, 112B. As shown in FIG. 1, adjacent rows 114A, 114B can be interconnected by a radiating element 116A, 116B at one end of the rows 114A, 114B. The metal traces 110A, 110B terminate at proximal terminals 118A, 118B.

Advantageously, the repeating structure of the plurality of cell elements 112A, 112B connected in series allow the metal traces 110A, 110B that define the arms 102A, 102B to be arranged so as to maximize its layout area to thereby yield maximum performance based on design requirements for the antenna 100. For example, the shape of the arms 102A, 102B can substantially approximate the shape of the printed circuit board on which the antenna 100 is disposed. That is, the arms 102A, 102B can define a shape that substantially coincides (e.g., are located adjacent, located inward of and adjacent) with an outer boundary of the printed circuit board area on which the antenna 100 is laid. For example, the number of cell elements 112A, 112B in each of the rows 114A, 114B can be so that each of the two or more rows 114A, 114B extends from a location adjacent an edge of the printed circuit board to a location adjacent another edge of the printed circuit board.

Figure 2:
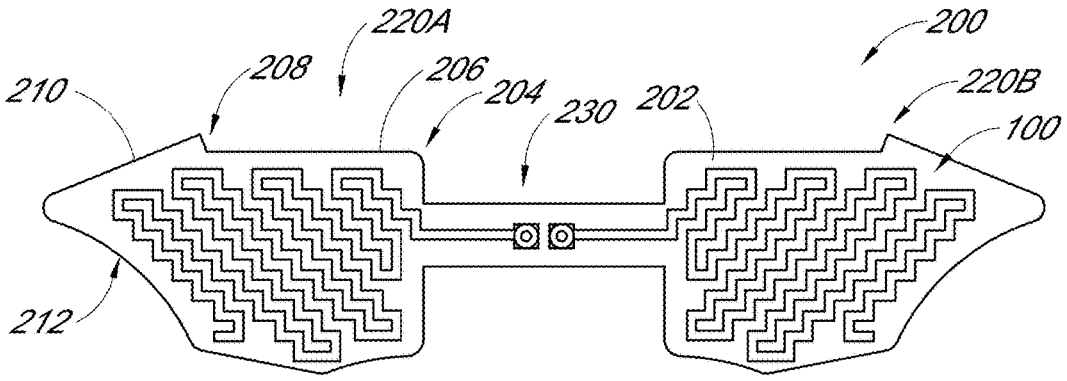
FIG. 2 is a schematic view of the 2D planar antenna of FIG. 1 on a planar printed circuit board (PCB)

FIG. 2 shows a top view of a printed circuit board (PCB) 200 with the antenna 100 disposed on a surface 202 of the PCB 200, providing an antenna structure 300. The PCB 200 can have a boundary 204 with an irregular shape (e.g., a shape other than square or rectangular). In the illustrated embodiment, the boundary 204 of the PCB 200 has one or more linear segments 206, one or more stepped segments 208, one or more angled segments 210 and one or more contoured (e.g., curved) segments 212. However, the PCB 200 can have other irregular shapes, as required by (e.g., to conform to the shape of) the product housing in which the PCB 200 is to be housed. As shown in FIG. 2, the antenna 100 has a shape (e.g., the shape of the radiating arms 102A, 102B) that substantially approximates the shape of the PCB 200, thereby maximizing the layout area of the antenna 100 and to conform to the product form factor.

Figure 3:
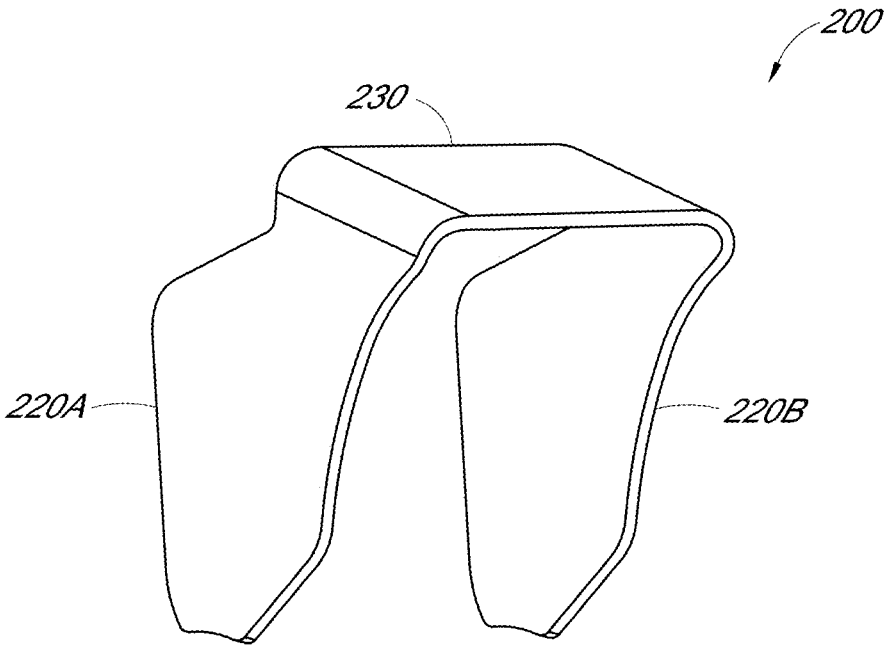
FIG. 3 is a schematic view of a three-dimensional (3D) structure into which the planar PCB in FIG. 2 is folded.

The PCB 200 is advantageously flexible (e.g., made of flexible material using a conventional flexible PCB process) that allows the PCB 200 to be bent or folded into a three-dimensional (3D) shape. For example, FIG. 3 shows the PCB 200 in FIG. 2 with the antenna 100 thereon folded into a 3D shape where opposite sides or arms 220A, 220B are folded relative to a center portion 230 of the PCB 200. Optionally, the PCB 200 is folded so that the arms 220A, 220B extend generally normal (e.g., perpendicular) relative to the center portion 230. Bending of the PCB 200 advantageously allows the antenna 100 to fit within a housing of reduced size that would not otherwise accommodate the antenna 100 in its two-dimensional orientation.

Figure 4A:
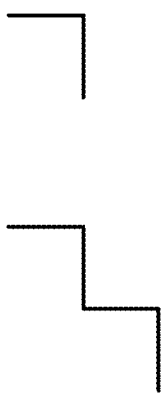
FIGS. 4A-4C are schematic views of different types of conductive element shapes or unit cell elements for use in an antenna.
Figure 4B:
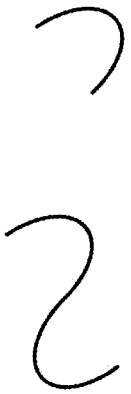
Figure 4C:
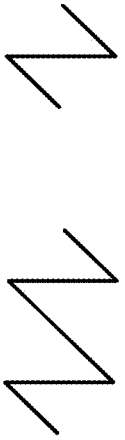

FIGS. 4A-4C show different cell element shapes that can be used for the plurality of cell elements 112A, 112B. In one embodiment, the plurality of cell elements 112A, 112B (connected in series in each row 114A, 114B) have an L shape or inverted L shape (see FIG. 4A), all cell elements oriented in the same direction. In another embodiment, shown in FIG. 4B, the plurality of cell elements 112A, 112B can each have a semi-circular shape, and the plurality of cell elements 112A, 112B in each row 114A, 114B can be connected in series so that adjacent semi-circular cell elements alternate in orientation so that adjacent semi-circular cell elements define a generally S-shape. FIG. 4C shows another embodiment where the plurality of cell elements 112A, 112B (connected in series in each row 114A, 114B) have a Z-shape, all cell elements oriented in the same direction. The dimensions of the cell elements 112A, 112B are determined as further described below.

Figure 5:
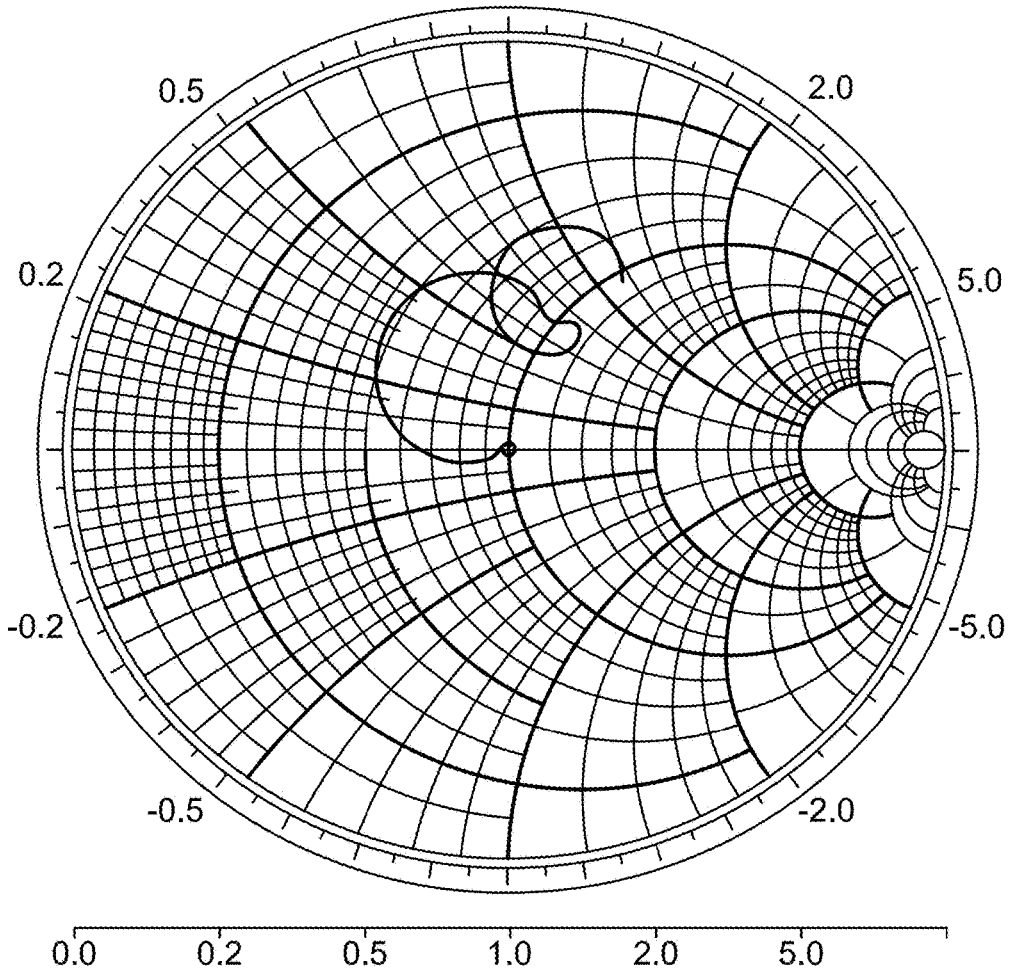
FIG. 5 is a diagram showing input impedance to dipole structure from 0.2 GHz to 8 GHz.

The antenna 100 advantageously has arms 102A, 102B that produce an omni-directional radiation pattern and has a good matching property at the terminals 118A, 118B. The arms 102A, 102B can have a length other than quarter-wavelength and can be adjusted using design simulation as described further below. For example, the arms 102A, 102B can have a length greater than ¼ wavelength, e.g. due to parasitic capacitance between adjacent structure. FIG. 5 shows a chart of input impedance for the antenna 100. Advantageously, the antenna 100 has a desired matching impedance near the origin of the chart, and is maintained whether the device (e.g., a hearing aid device) that incorporates the antenna 100 is worn on the left or right side of the human body.

Figure 6A:
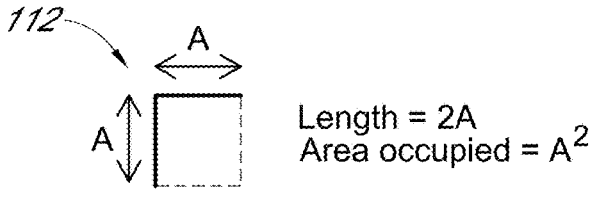
FIGS. 6A-6B is a schematic view of an inverted L unit cell element, and series connected multi-cell conductor.
Figure 6B:
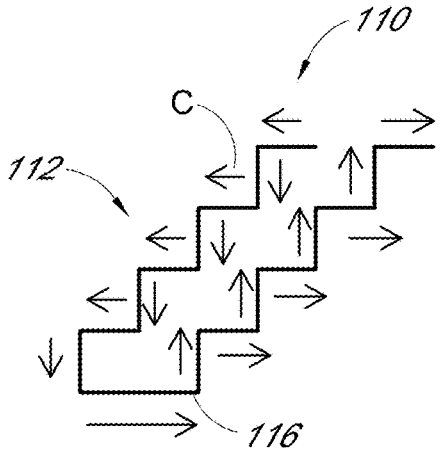

FIG. 6A shows one embodiment of an inverted L-shaped cell element 112, where the two arms of the L have the same length A. FIG. 6B shows a plurality of inverted L-shaped cell elements 112 connected in series to define a multi-cell conductor. In the illustrated embodiment, the conductor has two rows of inverted L-shaped cell elements 112 interconnected by a radiating element 116.

Figure 7:
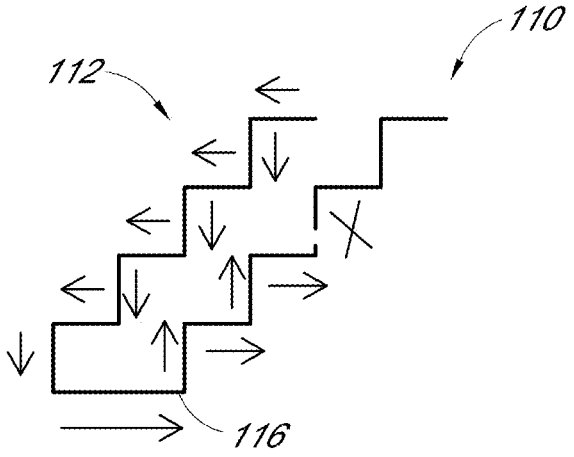
FIG. 7 is a schematic view showing the series connected multi-cell conductor of FIG. 6 once its length is trimmed to better match a desired performance.

Advantageously, the repeating structure of the antenna 100 (e.g., the plurality of cell elements 112 connected in series) allows the trimming of the length of the metal trace 110 by cutting one cell 112 at a time, as shown in FIG. 7, until the desired characteristic of the antenna 100 (e.g., better impedance matching) is achieved. Additionally, the repeating structure of the antenna 100 allows for in-situ trimming of the antenna 100 under normal operating conditions.

The antenna structure 300 incorporating the antenna 100 can optionally be incorporated into an audio device having any form factor, such as an ear piece that can be worn on, in or over the human ear. For example, the audio device can be an ear piece. The audio device can be a non-amplifying audio device (e.g., a device that does not amplify ambient sound).

Figure 8:
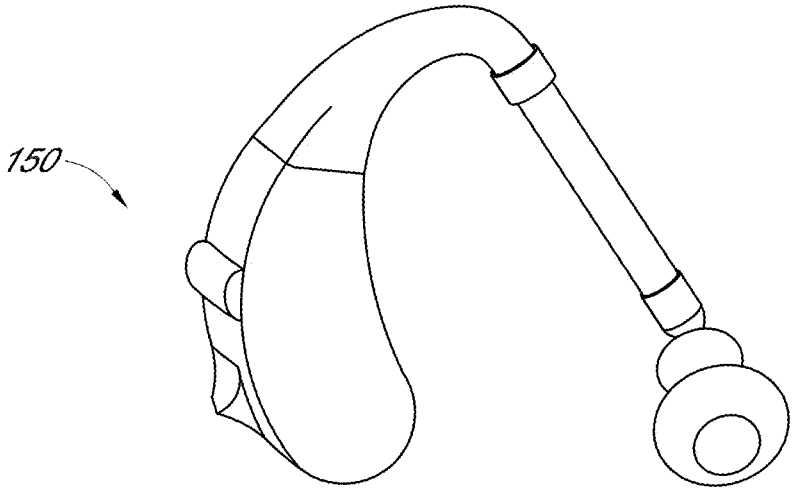
FIG. 8 is a schematic view of an audio amplification device that can incorporate one or more of the antenna designs disclosed herein.

FIG. 8 shows an audio amplification device 150 can incorporate the antenna structure 300. In the illustrated embodiment, the audio amplification device 150 is a hearing aid that can be supported over the person's ear. In particular, FIG. 8 shows a hearing aid that can be worn by a user on their left ear. A hearing aid that can be worn by the user on their right ear, which could also incorporate the antenna structure 300, would be a mirror image of the structure in FIG. 8. The hearing aid 150 can be a wireless hearing aid that fits over and/or is supported by one or both ears of the user, where the hearing aids are worn behind-the-ear and communicate wirelessly (e.g., via the antenna structure 300).

A variety of other form factors incorporating the antenna structure 300 are possible. FIGS. 9A-9D show schematic diagrams of multi-source audio amplification and ear protection devices according to various embodiments that can incorporate the antenna structure 300. The multi-source audio amplification and ear protection devices of FIGS. 9A-9D can include any suitable combination of features described herein, and illustrate four example device form factors.

Figure 9A:
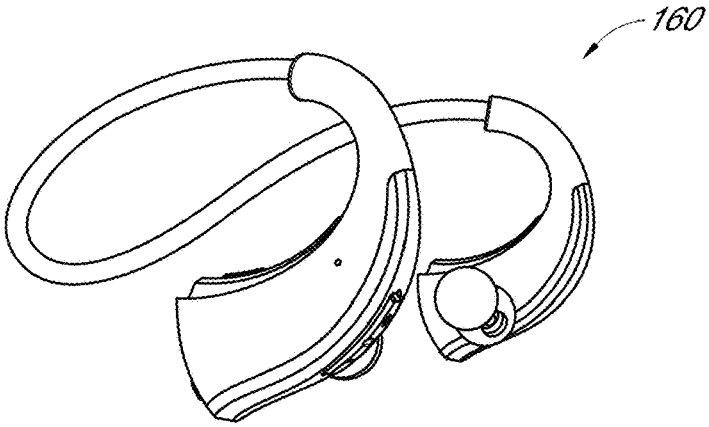
FIGS. 9A-9D are schematic views of audio amplification and ear protection devices that can incorporate one or more of the antenna designs disclosed herein.
Figure 9B:
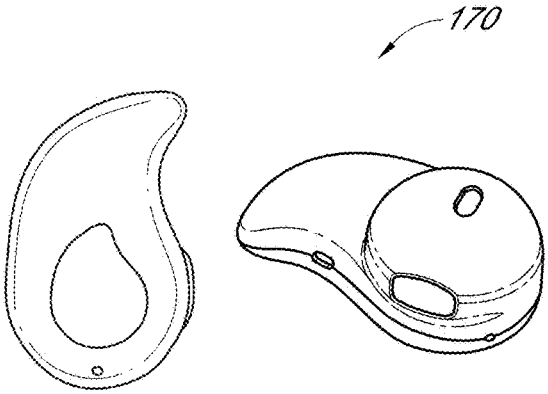
Figure 9C:
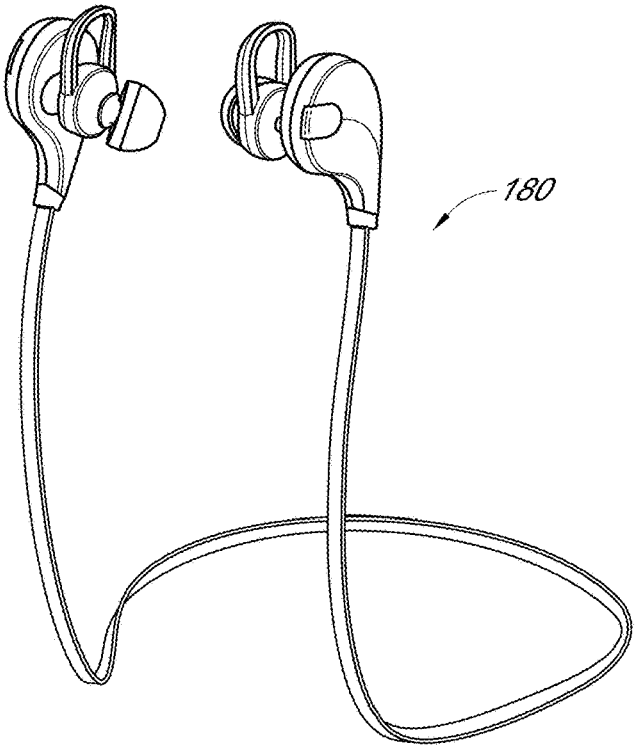

For instance, the multi-source audio amplification and ear protection device 160 of FIG. 9A includes headphones connected via a head strap that can be worn on a user's head. The multi-source audio amplification and ear protection device 170 of FIG. 9B includes ear plugs that can be inserted in a user's ears and that can communicate with one another wirelessly via the antenna structure 300. The multi-source audio amplification and ear protection device 180 of FIG. 9C includes headphones connected via a neck strap, which can aid the user to use the device while participating in mobile activities. The multi-source audio amplification and ear protection device 190 of FIG. 9D includes a headset with ear cups 192 connected by a headband 194.

Figure 9D:
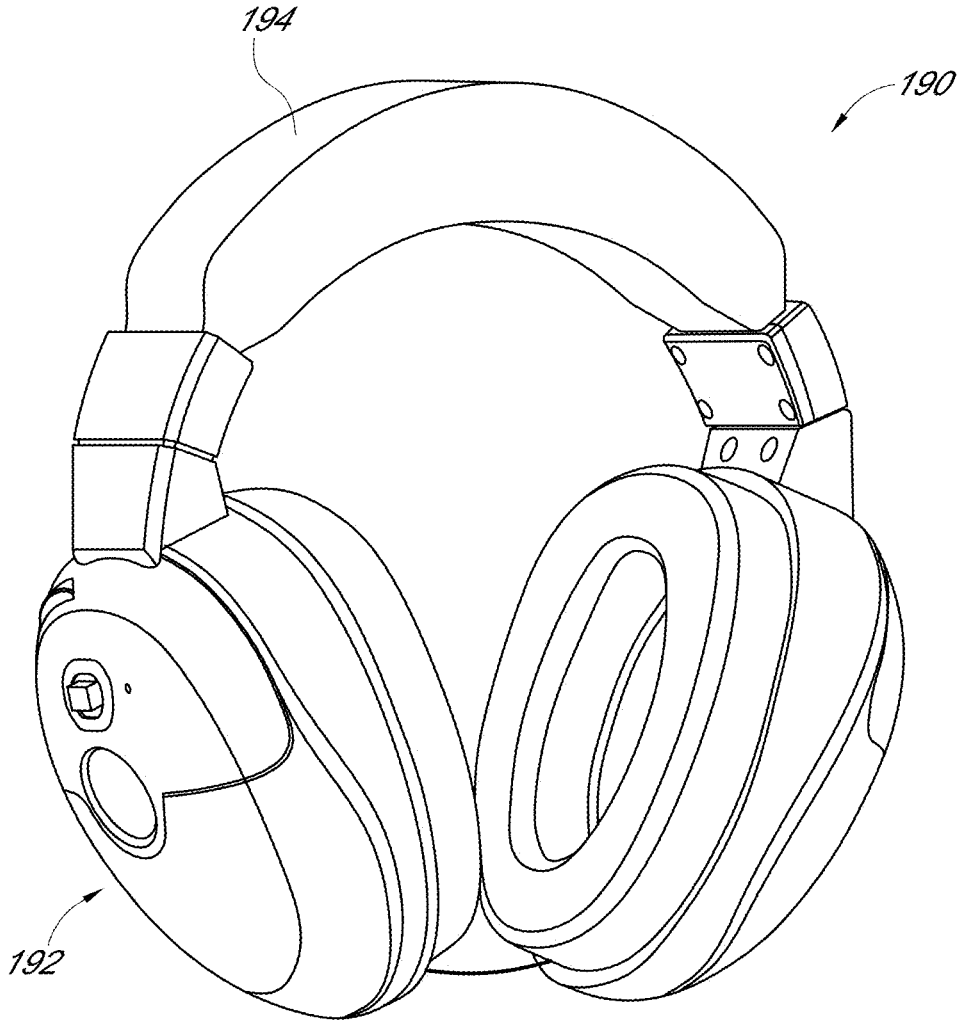

Although FIGS. 8-9D illustrate several example form factors, a multi-source audio amplification and/or ear protection device can be implemented in a wide variety of form factors and can include a wide range of features and functionality.

In such devices, such as those in FIGS. 8-9D, one side of the antenna structure 300 (e.g., one of the arms 220A, 220B) is in close proximity to the wearer's head, separated by the housing wall of the hearing aid device, so that the antenna structure 300 is effectively an asymmetrically loaded dipole antenna. When the user's head is close to the antenna structure 300, the electrical property of the metal traces 110A, 110B becomes distorted and is analogous to coupling to a large parasitic capacitor, where its parasitic energy would also flow through the length of the metal traces 110A, 110B, disturbing the proper voltage-current characteristic in an otherwise unloaded antenna 100.

Advantageously, the antenna structure 300 can tolerate significant variation in operating conditions due to close proximity to the human body. Additionally, the antenna structure 300 introduces a destructive interference to alleviate the effect of asymmetric loading due to the proximity of the antenna 100 to the user's head (e.g., when incorporated in a hearing aid). As shown in FIG. 6B, the effect of the current C flowing in the plurality of cell elements 112 in one row is canceled by the current flow in the adjacent row due to the opposite polarity of the current. This property keeps the loading effect to a minimum, but it leaves the non-repeating structure (e.g. radiating element 116A, 116B) as the effective radiator (e.g., only effective radiator) in the antenna 100. Advantageously, the radiating elements 116A, 116B of the antenna 100 are larger relative to the repeating cell elements 112. The antenna 100 therefore has a design resembling an electrically short dipole, but has a desired impedance matching at the terminals 118A, 118B.

Figure 10:
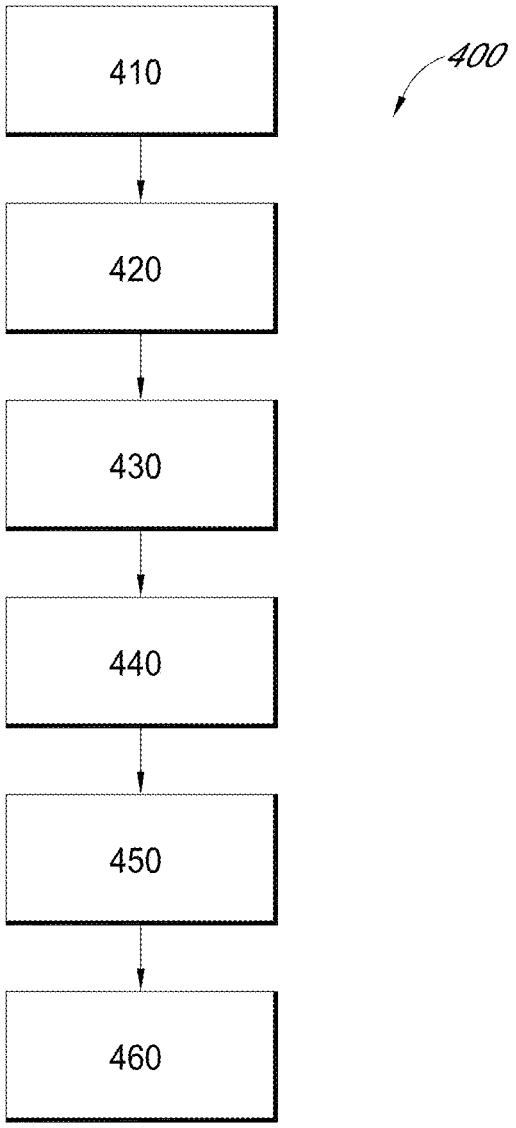
FIG. 10 illustrates a block diagram of a method of designing an antenna.

FIG. 10 shows a method 400 for optimizing design of an antenna as discussed in the embodiments herein, such as the antenna 100 in the antenna structure 300. The method 400 can be used to determine 410 the overall length, width, or both, of the metal traces 110A, 110B through an initial simulation (e.g., computer implemented software simulation). The total available area on the printed circuitry board 200 is calculated 420. With the total length of the metal traces 110A, 110B established, the dimension of the unit cell element (e.g., length A of cell 112 in FIG. 6A is calculated 430 using the total available surface area on the implementation space on the PCB 200. The method 400 can include determining 440 the coverage area of a unit cell element 112. For example, as shown in FIG. 6A, the unit cell element 112 with length A can have a coverage area of $A^2$. The number of unit cell elements needed for the antenna 100 can be determined 450 using a formula where the total available area by divided by the unit cell coverage area. The length A of the trace (e.g., of the cell 112), the width of the trace (e.g., cell 112), or both, can be optimized using a structure simulation tool. As an example, the width of the trace can be selected or modified to obtain a desired bandwidth, and the length A (of the cell 112) can be selected or modified to obtain a particular impedance at the terminals. The overall length of the metal traces 110A, 110B is determined 460 by multiplying the number of cells that can be accommodated on the implementation area (of the PCB 200) by the length of the cell element.

Advantageously, the antenna design disclosed herein, such as the antenna 100, and method of designing the antenna, simultaneously achieve two or more of the following: allow the antenna 100 to fit in a predetermined form factor, allow in-situ trimming of the antenna 100, optimize efficiency of the antenna 100 as a radiator and creates an omni-directional radiation pattern, reduce susceptibility to uneven loading due to proximity to the user's head when the device is worn by the user, and have an effective length that provides the desired impedance matching at the terminals for maximum power transfer through the interface to the transmitter and receiver, providing a good voltage standing wave ratio (VSWR).

Unless the context clearly requires otherwise, throughout the description and the claims, the words "comprise," "comprising," "include," "including" and the like are to be construed in an inclusive sense, as opposed to an exclusive or exhaustive sense; that is to say, in the sense of "including, but not limited to." The word "coupled", as generally used herein, refers to two or more elements that may be either directly connected, or connected by way of one or more intermediate elements. Likewise, the word "connected", as generally used herein, refers to two or more elements that may be either directly connected, or connected by way of one or more intermediate elements. Additionally, the words "herein," "above," "below," and words of similar import, when used in this application, shall refer to this application as a whole and not to any particular portions of this application. Where the context permits, words in the above Detailed Description using the singular or plural number may also include the plural or singular number, respectively. The word "or" in reference to a list of two or more items, that word covers all of the following interpretations of the word: any of the items in the list, all of the items in the list, and any combination of the items in the list.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially"

as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree. As another example, in certain embodiments, the terms "substantially coinciding with" refer to an amount or characteristic that departs from exactly coinciding with the described component by an amount that is within less than 10% of, within less than 5% of, within less than 1% of, within less than 0.1% of, and within less than 0.01% of the exact amount.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A method for determining design parameters of an antenna for an audio device, where the antenna includes one or more metal traces disposed on a printed circuit board, the method comprising:

calculating a total available area on a printed circuit board;

calculating a length of a unit cell element after calculating the total available area on the printed circuit board and based at least in part on the calculated total available surface area of an implementation space on the printed circuit board;

determining a coverage area of the unit cell element;

calculating the number of unit cell elements needed for the antenna by dividing the total available surface area by the coverage area of the unit cell element; and determining via computer implemented software a length of the one or more metal traces by multiplying the number of unit cell elements by the length of the unit cell element.

2. The method of claim 1, further comprising determining via computer implemented software a width of the one or more metal traces.

3. The method of claim 2 wherein said determining via computer implemented software a width includes selecting said width to obtain a desired bandwidth.

4. The method of claim 3 wherein said determining via computer implemented software a length of the one or more metal traces includes selecting said length to obtain a desired impedance at terminals of the antenna.

* * * * *